US006521809B1

(12) United States Patent
Smith et al.

(10) Patent No.: US 6,521,809 B1
(45) Date of Patent: Feb. 18, 2003

(54) TREATMENT OF ORGANIC MATERIALS

(75) Inventors: Alexander Hamilton Smith, Seascale (GB); Peter Jonathan Watson Rance, Seascale (GB); Timothy Nicholas Milner, Seascale (GB); Alistair McLeod Easthope, Seascale (GB)

(73) Assignee: British Nuclear Fuels plc, Cheshire (GB)

( * ) Notice: Subject to any disclaimer, the term of this patent is extended or adjusted under 35 U.S.C. 154(b) by 0 days.

(21) Appl. No.: 09/530,810

(22) PCT Filed: Oct. 28, 1998

(86) PCT No.: PCT/GB98/03218

§ 371 (c)(1),
(2), (4) Date: Feb. 5, 2001

(87) PCT Pub. No.: WO99/23669

PCT Pub. Date: May 14, 1999

(30) Foreign Application Priority Data

Nov. 5, 1997 (GB) ..... 9723258

(51) Int. Cl.[7] ..... G21F 9/00; A62D 3/00
(52) U.S. Cl. ..... 588/20; 588/227; 588/237
(58) Field of Search ..... 204/157, 15, 158.2; 588/20, 227, 237, 247, 243

(56) References Cited

U.S. PATENT DOCUMENTS 4,681,705 A * 7/1987 Robertson ..... 210/682
4,693,833 A * 9/1987 Toshikuni et al. ..... 210/759
5,564,105 A * 10/1996 Alvino et al. ..... 210/711
5,585,531 A * 12/1996 Barker et al. ..... 210/650
5,732,362 A * 3/1998 Izumida et al. ..... 588/19
5,848,363 A * 12/1998 Guillermier et al. ..... 210/759
6,254,782 B1 * 7/2001 Kreisler ..... 204/DIG. 13

FOREIGN PATENT DOCUMENTS

EP 0527416 A2 2/1993
EP 0672623 A1 9/1995

OTHER PUBLICATIONS

International Search Report for PCT Application No. PCT/GB98/03218.
Hutson, G.V.; "The Use of Oxidation and Other Processes for the Treatment of Liquid Organic Waste at BNFL, Sellafield, UK" *Wat. Sci. Tech.* 35:4 303–309 (1997).

* cited by examiner

*Primary Examiner*—Nam Nguyen
*Assistant Examiner*—Thomas H. Parsons
(74) *Attorney, Agent, or Firm*—Myers Bigel Sibley & Sajovec

(57) ABSTRACT

Processes for the treatment of solutions used for the decontamination of radioactively contaminated surfaces wherein the solution contains radioactive metal ions and organic complexing agents are described herein. The processes include treating the solutions with a reagent suitable for the destruction of the complexing agent and contains a metal capable of existing in more than one oxidation state, and raising the pH of the resultant solution to a level at which the metal of the reagent precipitates or flocs out of the solution. Processes in which the contaminated solutions are treated with electromagnetic radiation, treated with UV or visible radiation, and treated at an ambient temperature are also described herein.

10 Claims, No Drawings

TREATMENT OF ORGANIC MATERIALS

FIELD OF THE INVENTION

The present invention relates to the treatment of organic materials, especially to bring about decomposition and destruction of the same.

In many fields waste organic materials present problems in and potential hazards to the environment and efficient processes for their destruction are being sought. The present invention is particularly concerned -with the treatment of waste streams containing radioactive or toxic materials in the presence of chelating agents/sequestering agents/detergents, bringing about the removal of the metal species from solution and allowing the discharge of an essentially benign effluent. Conventional treatments of such solutions are unsuccessful for various reasons, for instance, because of the propensity of the chelating agent to carry the reagent through ion exchange processes or the undesirable downstream consequences of adding known precipitation agents (eg carbamates) to the solution.

Although reference will be made below to the use of the present invention in nuclear plant applications, the invention is also applicable to other types of processes including the treatment of waste streams containing toxic heavy metals.

BACKGROUND OF THE INVENTION

Photochemical advanced oxidation processes for the treatment of aqueous solutions containing non-biodegradable compounds rely mainly on the production of a potent oxidising agent, in particular, the hydroxyl radical. One possible source of hydroxyl radicals is Fenton's reagent, a mixture of hydrogen peroxide and ferrous ion. It has been shown recently (Hutson, G. V., *Wat. Sci. Tech.* Vol 35, No. 4, pp 303–309, 1997) that degradation rates may be significantly enhanced by UV/visible irradiation.

Processes for the decontamination of nuclear plant materials typically involve the use of detergent and other solutions to facilitate surface cleaning. These solutions contain organic relating agents, the function of which is to hold metallic species in solution. Once used, the resultant solution will contain, inter alia, organic complexing agents and radioactive metal cations. Desirably, the metal ions are then separated from the solution and the solution is recycled or disposed of. The complexing agent is preferably destroyed as part of this post-cleaning treatment and the resultant aqueous solution may then be sent to an effluent treatment plant or an ion exchange plant. Undestroyed chelating agents prevent successful treatment of such spent liquors in conventional effluent treatment plants and indeed may be undesirable in their own right as components of discharged effluents.

STATEMENTS OF INVENTION

Although use of Fenton's/UV is effective in destroying the organic complexing agent, the resultant aqueous solution then contains a substantial amount of iron ions. This presents a significant problem in the subsequent treatment of the solution. For instance, in subsequent ion exchange treatment, the iron ions will block the ion exchange resin and render its operation ineffective in removing the target metal ions from the solution. Similar problems will be encountered with the use of other reagents containing metal ions, examples being reagents which include a metal capable of being in more than one oxidation state during its use.

Examples of such reagents are those containing copper or chromium ions. Another problem ion is the aluminium ion, because it is preferentially adsorbed by ion exchange materials.

The present invention is concerned with a process for the treatment of a solution used for the decontamination of a radioactively contaminated surface, the solution containing radioactive metal ions and an organic complexing agent, the process comprising treating the solution with a reagent suitable for the destruction of the complexing agent and containing a metal capable of existing in more than one oxidation state, and raising the pH of the resultant solution to a level at which the metal of the reagent precipitates or flocs out of the solution.

Accordingly, the present invention envisages that, after the organic species has been destroyed, addition of alkaline material, especially a solution or powder, will raise the pH such that the metal ions of the reagent will form a floc which, as it forms and settles, removes the active species from the solution. In this way, the metal ions of the reagent, which previously had been seen as an obstacle to the use of such reagents, are now put to good purpose. Instead of preventing the effectiveness of the subsequent operation for the separation of the radioactive heavy metal ions, these reagent metal ions are themselves used to carry out the separation.

DETAILED DESCRIPTION OF THE INVENTION

The reagent used to destroy the organic complexing agent may be, for instance, based on a peroxide such as hydrogen peroxide. As an alternative to a peroxide, a perborate such as sodium perborate may be used. Preferably, the reagent is capable of providing active oxygen, for instance, in the form of a hydroxyl radical. Preferably, the reagent also includes a metal ion as a catalyst and, in particular, one capable of assuming more than one oxidation state.

A particular reagent which may be used in a process of the present invention is Fenton's reagent. This reagent is a mixture of hydrogen peroxide and ferrous ions. Under acidic conditions (in practice pH 1–5), this combination is a powerful oxidant of organic compounds, the hydroxyl radical being generally invoked as the primary reactive species which is generated. It is preferred in a process of the present invention that the reagent, preferably Fenton's reagent, is used together with UV or visible radiation. Such radiation has been found to strongly accelerate the action of Fenton's reagent, improving the degradation rates of organic complexing agents. This light-enhancement has been explained by ferric-sensitised reactions, mainly the photolysis of hydroxyl complexes of ferric yielding hydroxyl radicals and regenerating ferrous. Also believed to take place are photochemical reactions of complexes formed between ferric and the organic substrate or its intermediates of degradation, especially organic acids.

The metal ion having two or more oxidation states acts as a catalyst in the degradation of the organic complexing agents by the hydrogen peroxide or other reactant. As indicated above, the metal ion system may be that of a single metal, such as iron. However, the reagent may also include one or more other catalysts, for instance, other transition metals.

The degradation of the complexing agent made be carried out at any suitable temperature for the reagent which is used. In the case of Fenton's reagent, used with UV radiation, the rate of reaction is such that the degradation may be carried out at ambient temperatures.

In the case of the use of Fenton's reagent/UV, the optimum values of iron, hydrogen peroxide and UV radiation depend on the rate of reaction between hydroxyl radicals and the organic complexing agent and also on the optical density of the reaction solution. By way of example, a solution with an absorbence of approximately 2 for the depths of the reaction volume (depth of reaction solution from UV source to the outer boundary of the reaction volume) gives an absorption of 99% of the incident UV radiation. Significantly higher absorbencies will lead to areas of the reaction volume, those furthest from the source of UV, receiving no UV radiation, although with efficient stirring this can be accommodated. Absorbencies significantly less than two should desirably be avoided as these will lead to inefficient utilisation of the UV radiation as a proportion will pass through the reaction solution without being usefully absorbed.

The amount of iron necessary in the process according to the present invention depends on the amount of organic material to be destroyed and the concentration of hydrogen peroxide, and upon the rate of reaction between the organic material and the hydroxyl radicals. The faster this reaction is then the more iron which can be present in the system without a loss of efficiency brought about by the scavenging of the hydroxyl radicals by the iron. In practice, there is likely to be some trade-off between reaction efficiency and desired reaction rate since increasing the rate by increasing the amount of iron may lead to a drop in reaction efficiency. Typically, iron concentrations of from 0.05 to 5 g/l may be used; concentrations of about 1 g/l are often very suitable.

The concentration of hydrogen peroxide used in the process is dependent upon the rate of the reaction between organic complexing agent and the hydroxyl radicals. For ultimate efficiency only the stoichiometric amount should be added and this should be fed to the reaction solution at a rate that ensures that no peroxide is wastefully decomposed to oxygen. However, this may lead to an unacceptably slow reaction. Increasing the hydrogen peroxide concentration will lead to an increase in reaction rate but may lead to a reduction in reaction efficiency with respect to hydrogen peroxide usage.

The UV radiation is desirably present throughout the reaction as without it the reaction will slow since there is no photochemically induced regeneration of ferrous ion. Radiation of wavelength below 400 nm is necessary, preferably below about 320 nm. The 254 nm resonance line of a mercury lamp is very well suited to provide the UV source.

After completion of the photochemical destruction step, the active species are removed from the solution by the addition of an alkaline agent, typically NaOH or $Ca(OH)_2$, which causes precipitation of ferric floc containing insoluble metal hydroxides. This floc is compatible with routine disposal routes for radioactive wastes and can be separated from the solution and disposed of by known means. Species which remain insoluble at alkaline pH (for instance Cs and Sr) can be precipitated by the addition of known reagents.

The invention is illustrated by the following Examples.

EXAMPLE 1

A 1% solution (1 litre) of SDG3 (a decontaminant containing the chelators citric acid and EDTA) containing $HNO_3$ to control pH had added to it 1 g of ferrous sulphate to give 1000 ppm of dissolved iron to act as Fenton's reagent. The solution was dosed with $Pu(NO_3)_4$ (in an amount sufficient to give an activity concentration of 2600 Bq/ml), supplied with $H_2O_2$ and irradiated with UV light (254 nm). The operating parameters of the experiment were as set out in Table 1:

TABLE 1

| | |
|---|---|
| Liquor | SDG3 |
| Concentration | 1% |
| Contaminant | $Pu(NO_3)_4$ |
| Activity | 2600 Bq/ml |
| Temperature | 90° C. |
| $H_2O_2$ concentration | 2% |
| $H_2O_2$ feed rate | 2.67 ml/minute |
| pH | 2.0 |

The experiment was stopped when it was observed that bubbles were no longer forming, a sign that $CO_2$ was no longer being produced. The liquor was sampled throughout the experiment and analysed for Total Organic Carbon (TOC) and total alpha activity. After 90 minutes, the liquor was allowed to stand over night and then passed through an ion exchange material before being flocculated by raising the pH to 9 and filtering out the resulting ferrous hydroxide floc. The remaining liquor was further irradiated and, after a further 80 minutes, passed again through the floccing procedure. The results obtained are shown in Table 2:

TABLE 2

| Reaction Time (minutes) | TOC (ppm) | +/− | alpha Bq/ml | +/− | Comment |
|---|---|---|---|---|---|
| 0 | 1781 | 67 | 2668 | | |
| 30 | | | 2253 | | |
| 60 | | | 2282 | | |
| 90 | | | 1940 | | |
| 90 | | | 1781 | | After standing overnight |
| 90 | | | 1141 | | After ion exchanging |
| 90 | 842 | 82 | 13.3 | 1.58 | After floccing |
| 170 | 344 | 26 | 0.363 | 0.411 | After floccing |

The ion exchange material (polyantimonic acid, 5 g) was swamped by the large amount of ion present and thus was unable to achieve effective removal of the active Pu species from the solutions.

Floccing, by raising the pH, however, demonstrated good decontamination factors for alpha emissions even before complete destruction of organic material had occurred; it is probable that this is because the chelating properties of the SDG3 were destroyed before the organic components were completely decomposed.

Example 2

This example was performed using a sample of the effluent from a laundry which washes clothing from the "active" areas of a nuclear plant. The liquor contained an organic chelating agent and traces of alpha activity As with Example 1, $HNO_3$ was added to control pH and the liquor had added to it ferrous sulphate to give 370 ppm of dissolved iron to act as Fenton's reagent. The solution was supplied with $H_2O_2$ and irradiated with UV light (254 nm). The operating parameters of the experiment were as set out in Table 3:

TABLE 3

| | |
|---|---|
| Liquor | Laundry liquor |
| Contaminant | Unknown |
| Activity | 2.53 Bq/ml alpha |

TABLE 3-continued

| | |
|---|---|
| Temperature | 80° C. |
| $H_2O_2$ concentration | 2% |
| $H_2O_2$ feed rate | 1.4 ml/minute |
| pH | 1.03 |

The experiment was performed for 10 hours and the liquor was sampled throughout the experiment and analysed for Total Organic Carbon (TOC) and total alpha activity. The results obtained are shown in Table 4:

TABLE 4

| Reaction Time (hours) | TOC (ppm) | alpha Bq/ml |
|---|---|---|
| 0 | 410 | 2.53 |
| 1 | 330 | |
| 3 | 180 | |
| 4 | 120 | |
| 5 | 60 | |
| 6 | 40 | |
| 8 | 20 | |
| 9 | 10 | |
| 10 | 10 | 0.15 |

EXAMPLE 3

The experiment was performed on liquor from a washing process used to clean protective clothing from the plutonium handling areas of a nuclear plant. The decontaminant was a standard industrial detergent. As with Example 1, $HNO_3$ was added to control pH and the liquor had added to it ferrous sulphate to give 1000 ppm of dissolved iron to act as Fenton's reagent. The solution was supplied with $H_2O_2$ and irradiated with UV light (254 nm). The operating parameters are set out in Table 5 bellow:

TABLE 5

| | |
|---|---|
| Liquor | Cleaning process liquor |
| Concentration | Unknown |
| Contaminant | $PuO_2$ |
| Activity | 5 MBq/ml |
| Temperature | 80° C. |
| $H_2O_2$ concentration | 2% |
| $H_2O_2$ feed rate | 1.4 ml/minute |
| pH | 1–1.5 |

The alpha levels dictated use of a glove box, with the consequence that pH was determined with sticks instead of a meter, and so could not be determined so accurately as in the cases of Examples 1 and 2.

TABLE 6

| Reaction Time (hours) | alpha MBq/ml | +/− | Comment |
|---|---|---|---|
| 0 | 4.80 | 0.116 | |
| 0 | 0.382 | 0.00919 | Entire batch filtered on an 8 μm filter |
| 0 | 0.160 | 0.00562 | Sample filtered on a 0.02 μm filter |

TABLE 6-continued

| Reaction Time (hours) | alpha MBq/ml | +/− | Comment |
|---|---|---|---|
| 0 | 0.147 | 0.00536 | Sample flocced and filtered on an 8 μm filter |
| 1 | 0.0837 | 0.00398 | Ferric floc formed, pH raised, filtered on an 8 μm filter |

The reaction was stopped by the formation of the ferric floe and consequent removal 10 of iron from solution. It was decided to re-acidify the liquor to below pH 0 and to attempt to improve the decontamination factor (DF). The following results were then obtained:

TABLE 7

| Reaction Time (hours) (after re-acidification) | alpha Bq/ml | +/− | Comment |
|---|---|---|---|
| 0 | 83700 | 3980 | |
| 1.33 | 2253 | | Solution cloudy red, but less than before |
| 3 | | | As above |
| 4 | | | As above |
| 4 | <50 | | Sample flocced and filtered on an 8 μm filter |

It is apparent that the UV destruction and floccing steps have reduced the solution activity from 147,000 Bq/ml (the level achieved by floccing and filtration alone) to below 50 Bq/ml.

What is claimed is:

1. A process for the treatment of a solution used for the decontamination of a radioactively contaminated surface, the solution containing radioactive metal ions and an organic complexing agent, the process comprising treating the solution with a reagent suitable for the destruction of the complexing agent and containing a metal capable of existing in more than one oxidation state, and raising the pH of the resultant solution to a level at which the metal of the reagent precipitates or flocs out of the solution.

2. A process according to claim 1 wherein the reagent is capable of providing active oxygen.

3. A process according to claim 2 wherein the active oxygen is in the form of a hydroxyl radical.

4. A process according to claim 1 wherein the reagent is Fenton's reagent.

5. A process according to claim 1 wherein the reagent includes one or more catalysts.

6. A process according to claim 5 wherein the reagent includes one or more transition metal catalysts.

7. A process according to claim 6 wherein the reagent includes iron, chromium and/or copper.

8. A process according to claim 1 wherein the solution is additionally treated with electromagnetic radiation.

9. A process according to claim 8 wherein the electromagnetic radiation is UV or visible radiation.

10. A process according to claim 1 wherein the solution is treated at an ambient temperature.

* * * * *